US006445358B2

(12) United States Patent
Takahashi et al.

(10) Patent No.: US 6,445,358 B2
(45) Date of Patent: Sep. 3, 2002

(54) WIDEBAND ANTENNA MOUNTABLE IN VEHICLE CABIN

(75) Inventors: Toshiyuki Takahashi, Saitama-ken; Tomoki Ikeda, Fukushima-ken, both of (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/797,376

(22) Filed: Mar. 1, 2001

(30) Foreign Application Priority Data

Mar. 9, 2000 (JP) ..... 2000-065156

(51) Int. Cl.[7] ..... H01Q 1/42

(52) U.S. Cl. ..... 343/828; 343/702; 343/700 MS; 343/713; 343/872

(58) Field of Search ..... 343/828, 711, 343/712, 713, 702, 872, 700 MS; H01Q 1/42

(56) References Cited

U.S. PATENT DOCUMENTS 5,365,246 A * 11/1994 Rasinger et al. ..... 343/702
5,898,404 A * 4/1999 Jou ..... 343/700 MS
6,310,586 B1 * 10/2001 Takahashi et al. ..... 343/872
6,333,714 B1 * 12/2001 Takahashi ..... 343/700 MS
6,339,402 B1 * 1/2002 Mckivergan ..... 343/702

FOREIGN PATENT DOCUMENTS

JP 5-029821 2/1993
JP 2000-040908 2/2000

* cited by examiner

*Primary Examiner*—Hoanganh Le
(74) *Attorney, Agent, or Firm*—Brinks Hofer Gilson & Lione

(57) ABSTRACT

An antenna includes a radiation conductor unit constructed with a plurality of radiation conductors having different lengths which extend in parallel to each other from an electricity-supplying conductor and a grounded conductor unit which opposes said plurality of radiation conductor in an approximately parallel manner with a predetermined distance therebetween. The radiation conductor unit and the grounded conductor unit are contained in an insulating casing constructed by a pair of cases which is fixed to each other. The casing is provided with a plurality of projections for positioning the radiation conductor unit and the grounded conductor unit.

5 Claims, 6 Drawing Sheets

WIDEBAND ANTENNA MOUNTABLE IN VEHICLE CABIN

BACKGROUND OF THE INVENTION

1. Field of the Invention

The present invention relates to antennas, and more particularly relates to an on-board antenna used for receiving terrestrial television broadcast signals, etc.

2. Description of the Related Art

A conventional on-board antenna 50 for receiving terrestrial television broadcast signals is shown in FIG. 5. This conventional antenna 50 includes a rod-shaped radiation conductor 51 which is adjusted so as to resonate at a desired frequency. The angle between the radiation conductor 51 and a pedestal 52 is freely adjusted by inclining a supporting portion 53 relative to the pedestal 52. As shown in FIGS. 6A and 6B, this antenna 50 is attached on a rear window 61 or on a roof 62 of a vehicle 60.

Generally, to solve the problem of fading, which particularly occurs when signals are received by a moving antenna, a diversity receiving system is adopted in vehicles. In this system, a plurality of the antennas shown in FIG. 5 are used, and one of the antennas which exhibits the highest receiving level is selected.

With respect to the conventional antennas as described above, the operational bandwidth of a single antenna is not sufficiently wide. Thus, when a wide bandwidth must be covered, as in a case of receiving television broadcast signals, multiple antennas having different operational bandwidths are prepared. In addition, external circuits such as tuning circuits and amplifying circuits are attached. Accordingly, there has been a problem in that a considerably high total cost is incurred to obtain a wide operational bandwidth. In addition, since a plurality of antennas, each of which is relatively large, is used, the antennas are necessarily attached to the exterior of the vehicle. Thus, there are risks in that the antennas will be damaged or stolen. In addition, there is a problem in that the appearance of the vehicle is degraded.

SUMMARY OF THE INVENTION

In consideration of the above-described situation of the conventional technique, an object of the present invention is to provide an inexpensive and compact wideband antenna which is mountable in a vehicle cabin, which is fabricated by a simple process, and which causes small variation in characteristics.

To this end, an antenna of the present invention comprises a radiation conductor unit including an electricity-supplying conductor and a plurality of radiation conductors having different lengths which extend in parallel to each other from the electricity-supplying conductor; a grounded conductor unit which opposes the radiation conductors in an approximately parallel manner with a predetermined distance therebetween; an insulating casing which contains the radiation conductor unit and the grounded conductor unit; and a plurality of projections in an inwardly facing surface of the insulating casing for positioning the radiation conductor unit and the grounded conductor unit.

According to the antenna which is constructed as described above, multiple resonances occur between the radiation conductors having different lengths and the grounded conductor unit. Accordingly, overall frequency characteristics are improved in a frequency band including multiple resonance frequencies, and the operational bandwidth is increased. In addition, since the radiation conductors arranged in parallel to each other individually serve as radiators, the size of the antenna is reduced compared to conventional dipole antennas, so that the installation in a vehicle cabin is realized. In addition, since the projections for positioning the radiation conductors and the grounded conductor unit are provided on the inwardly facing surface of the casing, the radiation conductors and the grounded conductor unit are easily mounted at predetermined positions in the casing. Accordingly, fabrication process is simplified and variation in characteristics is reduced.

The radiation conductor unit may include two radiation conductors which are arranged in parallel to each other with a slit therebetween. Preferably, in such a case, one or more of the projections are inserted through the slit and are engaged with each of the radiation conductors. Accordingly, the risk is reduced in which the radiation conductors will be excessively close to each other and the characteristics of the antenna will be degraded.

One or more of the projections preferably abut against the peripheral edges of the radiation conductors at a plurality of positions. Accordingly, displacement of the radiation conductors is restrained, so that the positioning accuracy is increased.

One or more of the projections are preferably provided with a thinned portion for restraining the displacement of the radiation conductors in the thickness direction by fitting the radiation conductors on the thinned portion. Accordingly, the distance between the radiation conductors and the grounded conductor unit may be maintained constant.

Preferably, the insulating casing is constructed by fixing a pair of cases to each other with screws, and one or more of said projections serve as screw-receiving portions. Accordingly, number of projections which exclusively serve for positioning the radiation conductors is reduced, and the positioning accuracy is increased.

DESCRIPTION OF THE PREFERRED EMBODIMENTS

Embodiments of the present invention will be described below in conjunction with the accompanying drawings. FIG.

1 is an exploded perspective view of an antenna 10 according to a first embodiment of the present invention. The antenna 10 includes a casing which is constructed by fixing a first case 11*a* and a second case 11*b* together, a radiation conductor unit 12, and a grounded conductor unit 14. The radiation conductor unit 12 and the grounded conductor unit 14 are installed in the casing, and are supplied with electricity via a coaxial cable 15 which is led out from the casing.

Figure 2A:
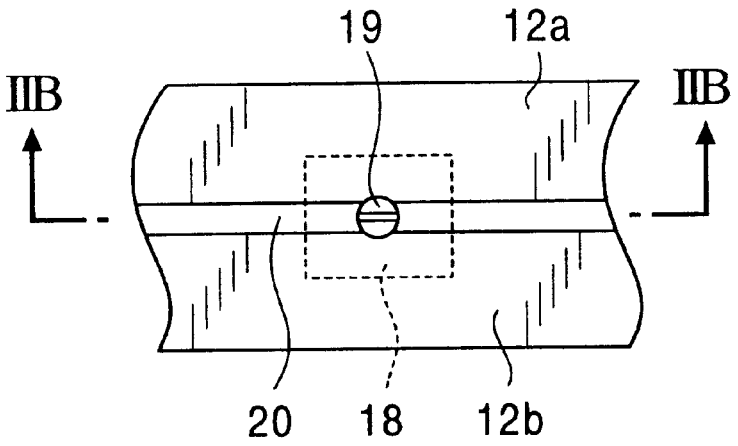
FIGS. 2A and 2B are explanatory drawings showing a manner in which the displacement of the radiation conductor unit shown in FIG. 1 is restrained.
Figure 2B:
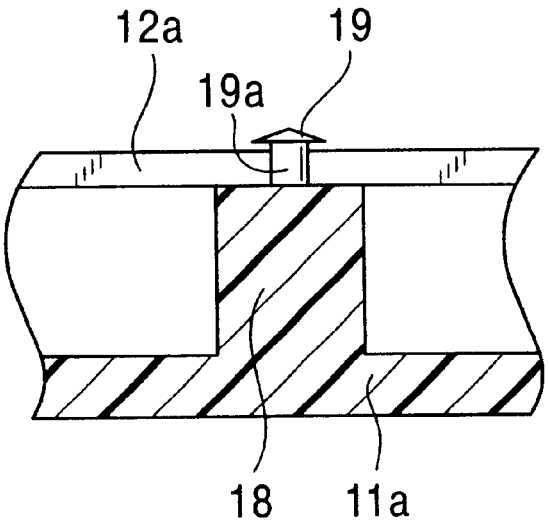

The first and the second cases 11*a* and 11*b* are constructed of an insulating and heat-resistant material such as ABS plastic. The first case 11*a* has the shape of an open container, and the second case 11*b* has the shape of an inverted open container. In the first embodiment, the first case 11*a* functions as a main case, and the second case 11*b* functions as a cover. Five fixing projections 17*a* to 17*e* and a pair of struts 18 are formed on the inwardly facing bottom surface of the first case 11*a*. The struts 18 are provided with restraining projections 19 on the upper side thereof, and each of the restraining projections 19 has a thinned portion 19*a* as shown in FIG. 2B. In addition, a semicircular tube 11*c* is formed at the upper edge of an end surface of the first case 11*a,* and a semicircular tube 11*d* is formed at a lower edge of an end surface of the second case 11*b*.

The radiation conductor unit 12 includes a first radiation conductor 12*a,* a second radiation conductor 12*b,* and an electricity-supplying conductor 13. The radiation conductors 12*a* and 12*b* have different lengths and are arranged in parallel to each other. The electricity-supplying conductor 13 is connected to each of the radiation conductors 12*a* and 12*b* at one longitudinal end thereof. The radiation conductors 12*a* and 12*b* and the electricity-supplying conductor 13 are integrally formed by bending a plate constructed of a highly conductive metal such as Cu, Al, etc. A slit 20 is formed between the first radiation conductor 12*a* and the second radiation conductor 12*b,* and the first radiation conductor 12*a* extends along the slit 20 in a form of a plate. The second radiation conductor 12*b* also extends along the slit 20 in a form of a plate, but is longer than the first radiation conductor 12*a*. The leading end of the second radiation conductor 12*b* is bent in the shape of a bracket. The bottom plate portion of this bracket forms an attachment tab 12*c* having an insertion hole 16*b*. The electricity-supplying conductor 13 is provided with a receiving portion 13*a,* which is electrically connected to an inner conductor 15*a* of the coaxial cable 15, and an attachment tab 13*b* having an insertion hole 16*a* at the lower side thereof. The receiving portion 13*a* and the attachment tab 13*b* are integrally formed in the shape of a step. The attachment tab 13*b* and the above-described attachment tab 12*c* are formed in the same plane, and are fixed to the inwardly facing bottom surface of the first case 11*a* by inserting the fixing projections 17*a* and 17*b* through the insertion hole 16*a* and 16*b,* respectively.

The grounded conductor unit 14 opposes the first and the second radiation conductors 12*a* and 12*b* in an approximately parallel manner with a predetermined distance therebetween. The grounded conductor unit 14 includes a receiving portion 14*a* and a holding portion 14*b* at one end, which are integrally formed by bending a plate constructed of a highly conductive material such as Cu, Al, etc. The grounded conductor unit 14 is provided with three insertion holes: insertion holes 16*c* and 16*d* at one end, and an insertion hole 16*e* at the other end. The receiving portion 14*a* is provided for electrically connecting an outer conductor 15*b* of the coaxial cable 15 thereto, and is formed in the shape of a bracket so that the outer conductor 15*b* can be inserted therein. The holding portion 14*b* is provided for supporting an insulator 15*c* of the coaxial cable 15, and is formed in the shape of a bracket so that the insulator 15*c* can be inserted therein. The fixing projections 17*c,* 17*d,* and 17*e* are inserted through the insertion holes 16*c,* 16*d,* and 16*e,* respectively, to fix the grounded conductor unit 14 to the inwardly facing bottom surface of the first case 11*a*.

The coaxial cable 15 is constructed by forming the insulator 15*c* and the outer conductor 15 around the inner conductor 15*a* disposed in the center. The inner conductor 15*a* is connected to the receiving portion 13*a* of the electricity-supplying conductor 13 by soldering, and the outer conductor 15*b* is clamped by the receiving portion 14*a* of the grounded conductor unit 14. Accordingly, the electricity-supplying conductor 13 and the grounded conductor unit 14 are supplied with electricity through the inner conductor 15*a* and outer conductor 15*b*. In addition, the insulator 15*c* of the coaxial cable 15 is clamped by the holding portion 14*b* of the grounded conductor unit 14, and the exterior of the coaxial cable 15 is sandwiched by the semicircular tubes 11*c* and 11*d* of the first and the second cases 11*a* and 11*b*.

Next, the fabrication process of the antenna 10 having the above-described construction will be explained below. First, the fixing projections 17*a* to 17*e* are respectively inserted through the insertion holes 16*a* and 16*b* formed in the radiation conductor unit 12 and the insertion holes 16*c* to 16*e* formed in the grounded conductor unit 14. Then, the attachment tabs 12*c* and 13*b* and the grounded conductor unit 14 are fixed to the inwardly facing bottom surface of the first case 11*a* by deforming the ends of the fixing projections 17*a* to 17*e,* by using an adhesive, or by other means. FIG. 2A is a plan view of a part of the radiation conductor unit 12, and FIG. 2B is a cross sectional view of FIG. 2A along line IIB—IIB. As show in FIGS. 2A and 2B, the radiation conductors 12*a* and 12*b* are supported by the strut 18, and the restraining projections 19 are inserted through the slit 20. Accordingly, the thinned portions 19*a* of the restraining projections 19 are engaged with the edge portions of the radiation conductors 12*a* and 12*b*. Thus, the radiation conductor unit 12 and the grounded conductor unit 14 are positioned and fixed by the fixing projections 17*a* to 17*e*. In addition, the radiation conductors 12*a* and 12*b* are positioned by the struts 18 and the restraining projections 19. Accordingly, the width of the slit 20 and the distance between the radiation conductors 12*a* and 12*b* and the grounded conductor unit 14 is maintained constant. The coaxial cable 15 is then introduced from the upper side of the first case 11*a*. The outer conductor 15*b* and the insulator 15*c* are inserted into the receiving portion 14*a* and the holding portion 14*b,* respectively. The inner conductor 15*a* at the leading end is put on the receiving portion 13*a,* and the exterior of the coaxial cable 15 is fitted into the semicircular tube 11*c*. Then, the insulator 15*c* is clamped and fixed by the holding portion 14*b,* and the outer conductor 15*b* is clamped and fixed by the receiving portion 14*a*. Thus, the outer conductor 15*b* is electrically and mechanically connected to the grounded conductor unit 14. The inner conductor 15*a* is soldered on and electrically connected to the receiving portion 13*a*. The outer conductor 15*b* may also be soldered on the receiving portion 14*a* to ensure reliability. In addition, the outer conductor 15*b* and the insulator 15*c* may also be fixed by means other than clamping, for example, by press fitting. Lastly, the opening at the upper side of the first case 11*a* is covered by the second case 11*b* in a manner such that the coaxial cable 15 is led out through the semicircular tubes 11*c* and 11*d*. The first and the second cases 11*a* and 11*b* are then fixed to each other by screws, snaps, an adhesive, or by other means. Accordingly, the fabrication of the antenna 10 containing the radiation conductor unit 12 and the grounded conductor unit 14 in the first and the second cases 11*a* and 11*b* is completed.

In the above-described antenna 10, multiple resonances occur between the first and the second radiation conductors 12*a* and 12*b* having different lengths and the grounded conductor unit 14. Accordingly, overall frequency characteristics are improved in a frequency band including multiple resonance frequencies, and the operational bandwidth is increased. In addition, since the first and the second radiation conductors 12*a* and 12*b*, which are arranged in parallel to each other, individually serve as radiators, the size of the antenna 10 is reduced, so that the installation in a vehicle cabin is realized.

As described above, the receiving portions 13*a* of the radiation conductor unit 12 and the receiving portion 14*a* of the grounded conductor unit 14 are disposed in the first case 11*a*, and are covered by the second case 11*b*. In addition, the coaxial cable 15 for supplying electricity is sandwiched by the semicircular tubes 11*c* and 11*d* of the first and the second cases 11*a* and 11*b*. Accordingly, the operation of connecting the coaxial cable 15 is easily performed while the second case 11*b* is removed. In addition, the fixing projections 17*a* to 17*e*, the struts 18, and the restraining projections 19 are utilized in the process of installing the radiation conductor unit 12 and the grounded conductor unit 14 into the first case 11*a*. The fixing projections 17*a* to 17*e* position and fix the radiation conductor unit 12 and grounded conductor unit 14. The struts 18 determine the vertical position of the radiation conductors 12*a* and 12*b*, and the restraining projections 19 restrain the displacement of the radiation conductors 12*a* and 12*b* by using the slit 20. Thus, the radiation conductor unit 12 and the grounded conductor unit 14 are easily installed inside the first case 11*a* at predetermined positions. Accordingly, the antenna 10 is fabricated by a significantly simple process. In addition, the radiation conductor unit 12 and the grounded conductor unit 14 are positioned with high accuracy, so that variation in characteristics of the antenna is reduced.

When the attachment tabs 12*c* and 13*b* are formed not in a horizontal manner but in an inclined manner toward the lower side, the insertion holes 16*a* and 16*b* and the fixing projections 17*a* and 17*b* are not necessary for positioning and fixing the radiation conductor unit 12. In such a case, the radiation conductor unit 12 is installed in the first case 11*a* by pressing the attachment tabs 12*c* and 12*b* against the inwardly facing bottom surface of the first case 11*a*. At this time, the edge portions of the radiation conductors 12*a* and 12*b* are fitted into the thinned portions 19*a* of the restraining projections 19, while the attachment tabs 12*c* and 12*b* are deformed. Accordingly, the radiation conductors 12*a* and 12*b* are pressed upward against the top portion of the restraining projections 19 by an opposing force generated by the attachment tabs 12*c* and 13*b*. Thus, the radiation conductors 12*a* and 12*b* and the receiving portion 13*a* are positioned and supported at predetermined positions.

Figure 3A:
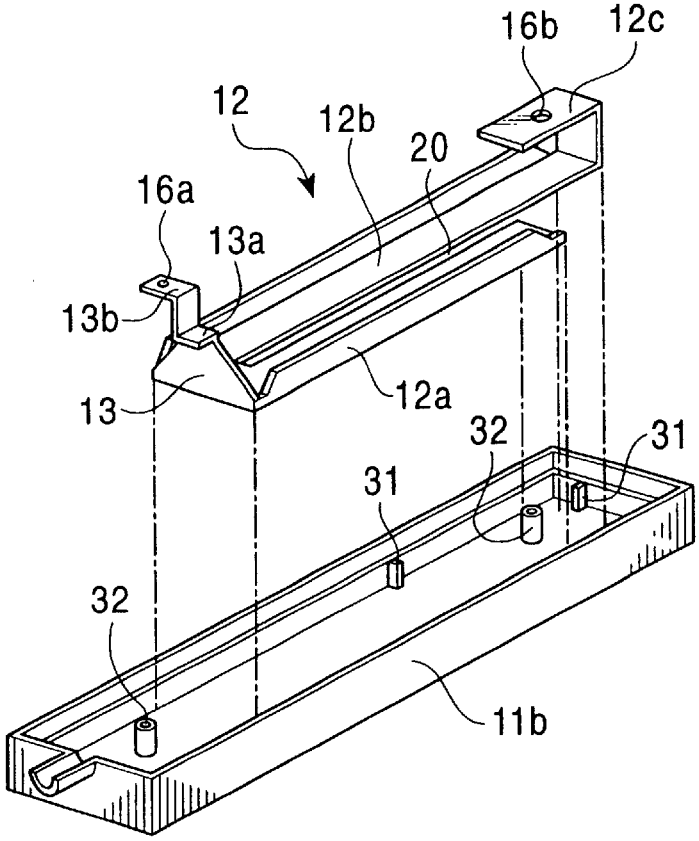
FIGS. 3A and 3B are explanatory drawings showing a manner in which a radiation conductor unit of an antenna according to a second embodiment of the present invention is installed.
Figure 3B:
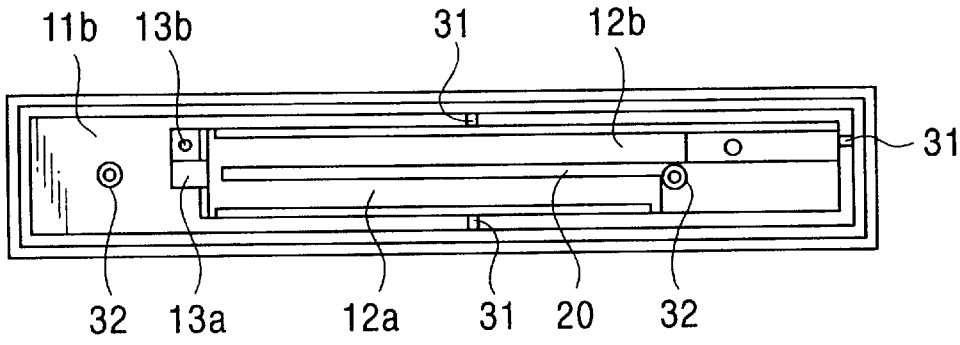

FIGS. 3A and 3B show a part of an antenna according to a second embodiment of the present invention. According to the second embodiment, a second case 11*b*, which functions as a cover, is provided with a plurality of projections for positioning the radiation conductors 12*a* and 12*b* of the radiation conductor unit 12. These projections include three restraining projections 31, which are disposed so as to abut against the peripheral edges of the radiation conductors 12*a* and 12*b*, and one of two screw-receiving portions 32, which are used for fixing the second case 11*b* to the first case 11*a* (not shown) by screws. As shown in FIG. 3B, one of the screw-receiving portions 32 is disposed at an end of the slit 20. This screw-receiving portion 32 serves to position the radiation conductors 12*a* and 12*b*, and is designed so as to abut against the end surface of the first radiation conductor 12*a* and on the side surface of the second radiation conductor 12*b*.

Since the restraining projections 31 and one of the screw-receiving portions 32 abut against a plurality of positions in the peripheral edges of the radiation conductors 12*a* and 12*b*, the displacement of the radiation conductors 12*a* and 12*b* is restrained and the positioning accuracy is increased. In addition, one of the screw-receiving portions 32, which are necessary for fixing the first and the second cases to each other, is also used for positioning the radiation conductors 12*a* and 12*b*. Thus, the number of projections which exclusively serve to position the radiation conductors 12*a* and 12*b* is reduced.

Figure 1:
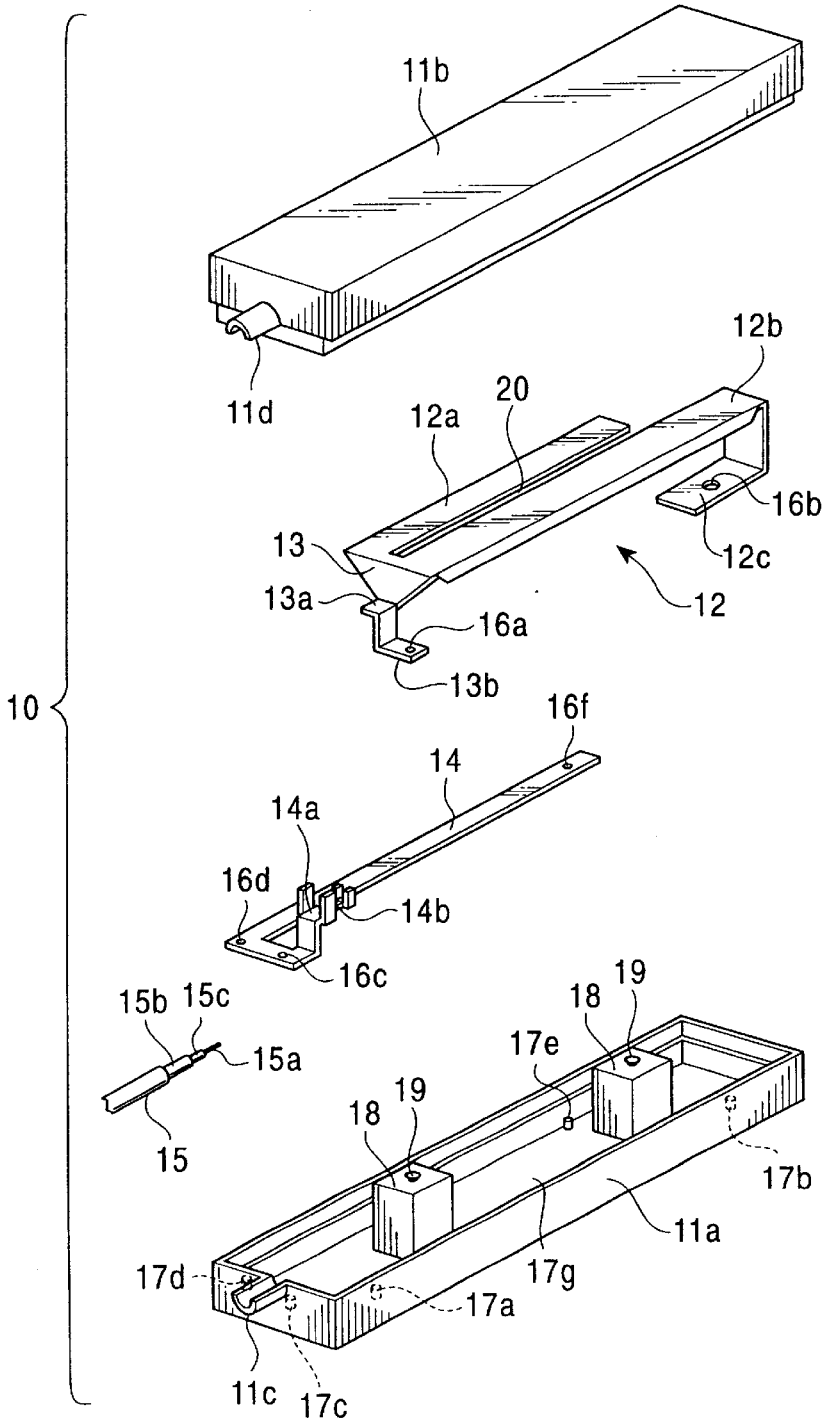
FIG. 1 is an exploded perspective view of an antenna according to a first embodiment of the present invention.

When the second case 11*b* is capable of positioning the radiation conductors 12*a* and 12*b* as described above, there is no need to provide the struts 18 and restraining projections 19 in the first case 11*a* as shown in FIGS. 1 and 2. The attachment tabs 12*c* and 12*b* of the radiation conductor unit 12 and the grounded conductor unit (not shown in FIGS. 3A and 3B), however, are fixed to the inwardly facing bottom surface of the first case in a similar manner as described in the first embodiment. Thus, the fixing projections 17*a* to 17*e* shown in FIG. 1 are still necessary.

Figure 4:
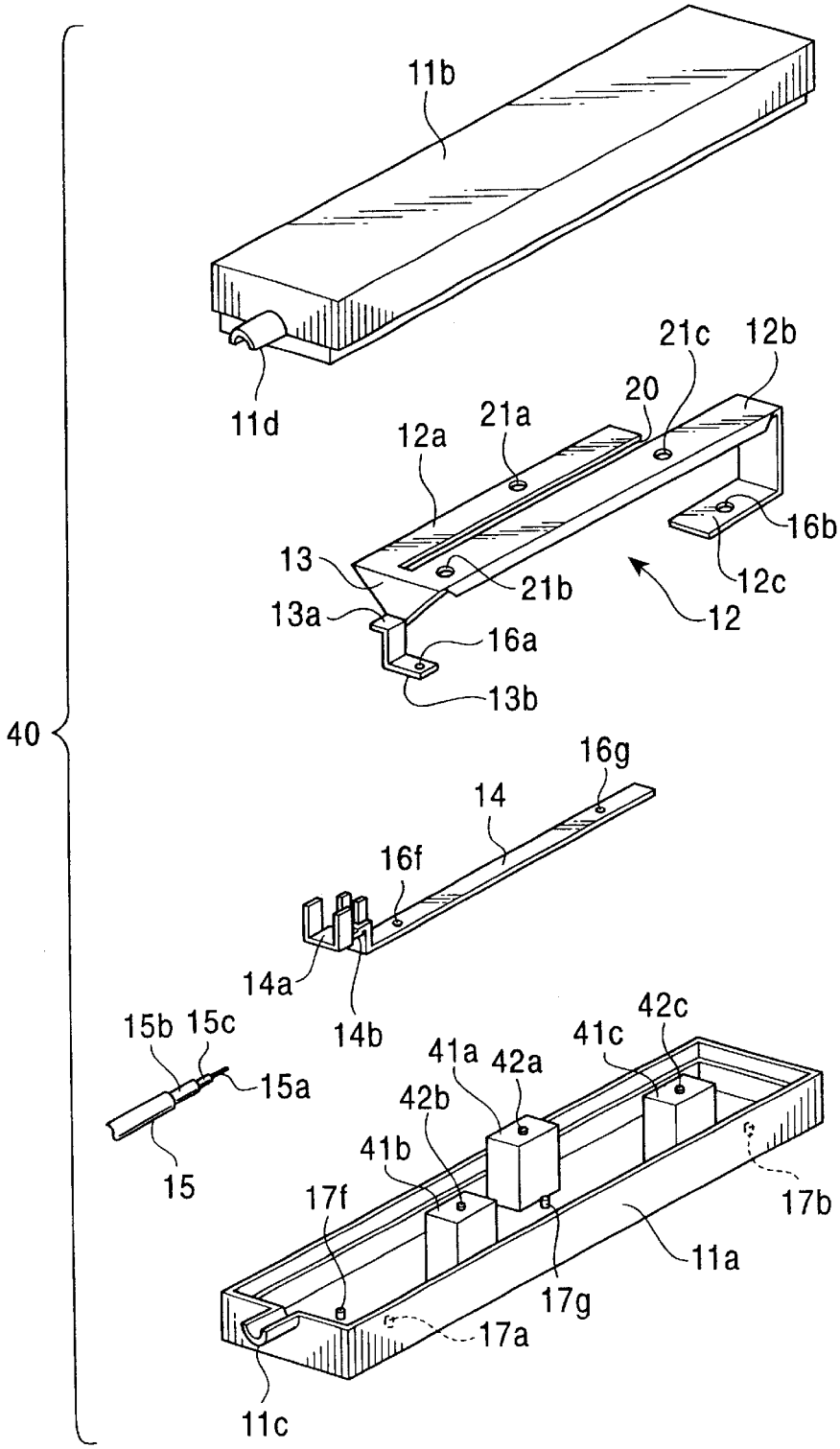
FIG. 4 is an exploded perspective view of an antenna according to a third embodiment of the present invention.
Figure 5:
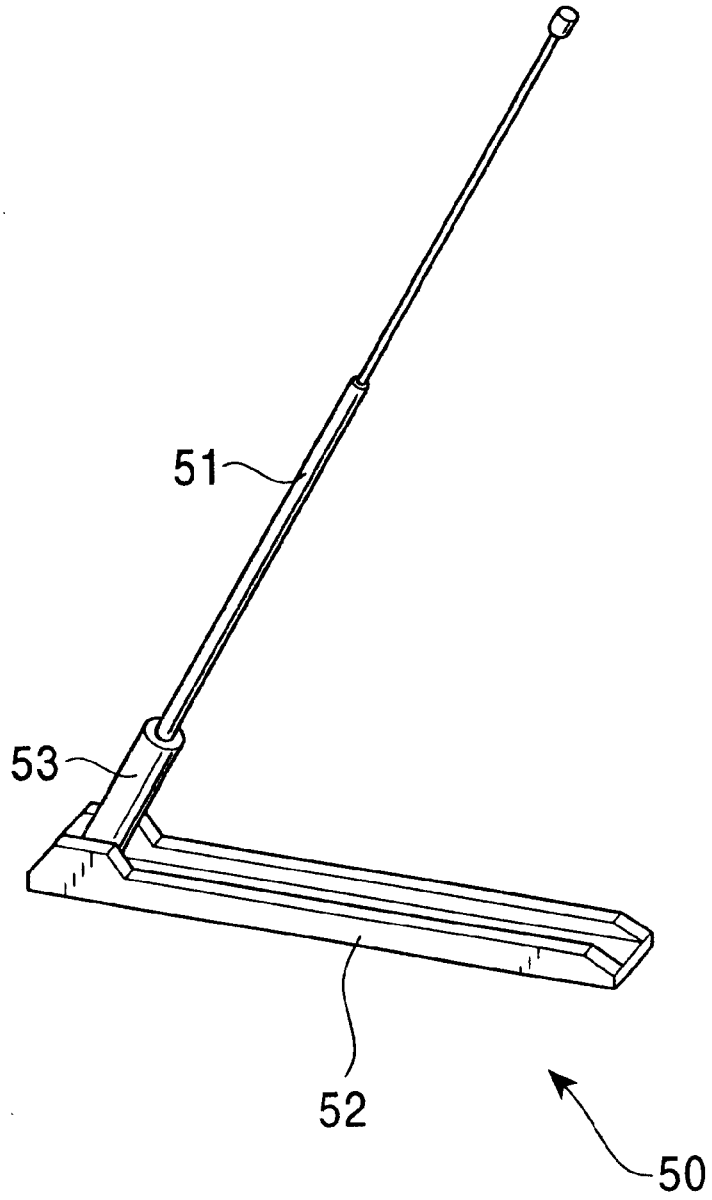
FIG. 5 PRIOR ART
FIG. 5 is a perspective view of a conventional on-board antenna.
Figure 6A:
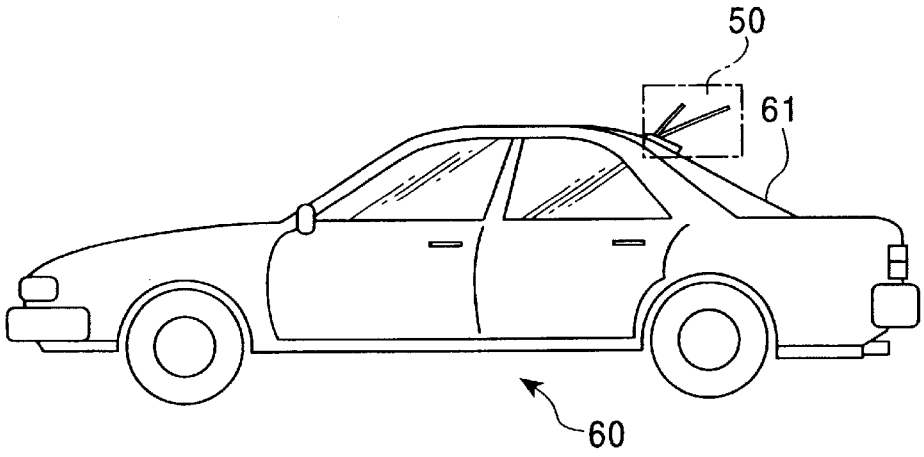
FIG. 6A PRIOR ART
FIGS. 6A and 6B are side views of a vehicle showing manners in which the conventional on-board antenna is mounted.
Figure 6B:
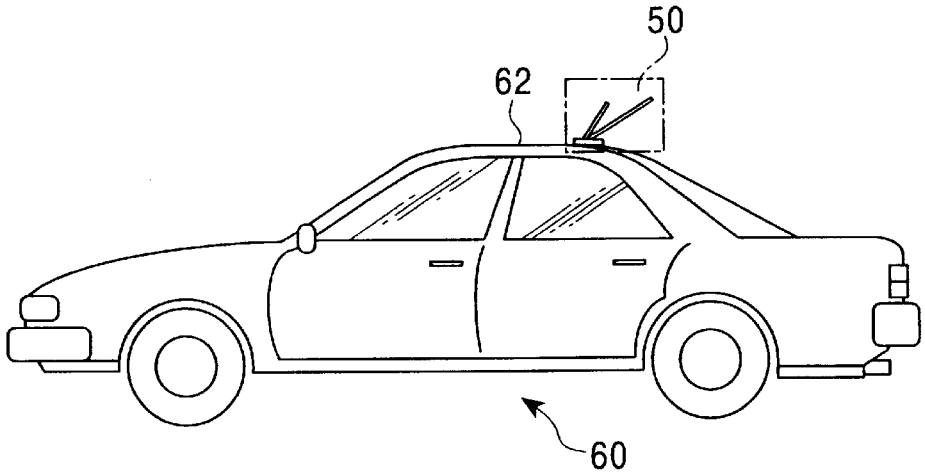
FIG. 6B PRIOR ART

FIG. 4 is an exploded perspective view of an antenna 40 according to a third embodiment. The antenna 40 differs from the antenna 10 of the first embodiment shown in FIG. 1 in the following point. That is, the antenna 40 includes three struts 41*a* to 41*c* which are provided with positioning projections 42*a* to 42*c*, respectively, on the upper surfaces thereof. The positioning projections 42*a* to 42*c* are inserted into insertion holes 21*a* to 21*c*, respectively, which are formed in the radiation conductors 12*a* and 12*b* of the radiation conductor unit 12. With reference to FIG. 4, the radiation conductor unit 12 is positioned and fixed on the inwardly facing bottom surface of the first case 11*a* by inserting the fixing projections 17*a* and 17*b* into the attachment tabs 12*c* and 13*b*. At this time, the first radiation conductor 12*a* is supported by the strut 41*a* in a manner such that the positioning projection 42*a* is inserted through the insertion hole 21*a*. Similarly, the second radiation conductor 12*b* is supported by the struts 41*b* and 41*c* in a manner such that the positioning projections 42*b* and 42*c* are inserted through the insertion holes 21*b* and 21*c*, respectively. Thus, the radiation conductors 12*a* and 12*b* are positioned with high accuracy, so that variation in characteristics of the antenna is reduced.

The grounded conductor unit 14 of the third embodiment has a different shape compared to that in the first embodiment. As shown in FIG. 4, the grounded conductor unit 14 of the antenna 40 is designed so as to be positioned and fixed on the inwardly facing bottom surface of the first case 11*a* in a manner such that fixing projections 17*f* and 17*g* are inserted through insertion holes 16*f* and 16*g*. In addition, the grounded conductor unit 14 is positioned directly below the slit 20 between the radiation conductors 12*a* and 12*b*. Other parts of the antenna 40 shown in FIG. 4 have the same constructions as those described in the first embodiment. Thus, components corresponding to those shown in FIG. 1 are denoted by the same reference numerals, and redundant explanations are thus omitted.

What is claimed is:

1. An antenna comprising:

a radiation conductor unit including an electricity-supplying conductor and a plurality of radiation conductors having different lengths which extend in parallel to each other from said electricity-supplying conductor;

a grounded conductor unit which opposes said plurality of radiation conductors in an approximately parallel manner with a predetermined distance therebetween;

an insulating casing which contains said radiation conductor unit and said grounded conductor unit; and a plurality of projections in an inwardly facing surface of said insulating casing for positioning said radiation conductor unit and said grounded conductor unit.

2. The antenna according to claim 1, wherein said radiation conductor unit includes two radiation conductors which are arranged in parallel to each other with a slit therebetween, and wherein one or more of said projections are inserted into said slit and are engaged with each of said two radiation conductors.

3. The antenna according to claim 1, wherein one or more of said projections abut against the peripheral edges of said plurality of radiation conductors.

4. The antenna according to claim 1, wherein one or more of said projections are provided with a thinned portion for restraining the displacement of said plurality of radiation conductors in the thickness direction by fitting said plurality of radiation conductors on said thinned portions.

5. The antenna according to claim 1, wherein said insulating casing is constructed by fixing a pair of cases to each other with screws, and wherein one or more of said projections serve as screw-receiving portions.

* * * * *